US007090650B2

(12) United States Patent
Ou et al.

(10) Patent No.: US 7,090,650 B2
(45) Date of Patent: Aug. 15, 2006

(54) CONTINUOUS PASSIVE MOTION EXERCISE SYSTEM WITH DRIVEN MONITORING

(75) Inventors: Yeong-Jeong Ou, Keelung (TW); Jeng-Shie Chung, Hsinchu (TW); Meng-Kai Su, Taipei (TW); Jian-Je Jian, Shijr (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 595 days.

(21) Appl. No.: 10/330,059

(22) Filed: Dec. 30, 2002

(65) Prior Publication Data

US 2004/0127821 A1 Jul. 1, 2004

(51) Int. Cl.
*A61H 1/00* (2006.01)
*A61H 1/02* (2006.01)

(52) U.S. Cl. ..... 601/5; 601/33

(58) Field of Classification Search ..... 601/5, 601/33–35, 84, 85, 87, 89, 23, 24, 26, 31; 482/8

See application file for complete search history.

(56) References Cited

U.S. PATENT DOCUMENTS 5,186,695 A * 2/1993 Mangseth et al. ..... 482/6
6,312,398 B1 * 11/2001 Cencer ..... 601/40
6,599,255 B1 * 7/2003 Zhang ..... 600/587
2004/0106881 A1 * 6/2004 McBean et al. ..... 601/5
2005/0101887 A1 * 5/2005 Stark et al. ..... 601/5

* cited by examiner

*Primary Examiner*—Danton Demille
*Assistant Examiner*—Manuj Agarwal
(74) *Attorney, Agent, or Firm*—Arent Fox PLLC

(57) ABSTRACT

The continuous passive motion exercise system enables human's joints to recover speedily to original functioning after injuries or surgeries, and thus shortens the period of time needed for joint rehabilitation. The present invention provides a force or torque monitoring device attached onto a continuous passive motion exercise mechanism to measure the driving force of the repeated joint flexing and extending motion, so as to evaluate the change of the viscosity and the stiffness of the injured joints through different rehabilitation periods. This monitoring device also monitor degrees of joint muscle's active contraction and thus slows down or stops the repeated motions of exercise mechanisms to improve safety concerns. In addition, such a monitoring device also includes a data transceiver interface utilized for transmitting and receiving the information regarding a patient's states of using such a exercise system in order to assess the patient and to provide doctors with the basis for evaluating and improving the rehabilitation condition of the injured joints.

6 Claims, 2 Drawing Sheets

CONTINUOUS PASSIVE MOTION EXERCISE SYSTEM WITH DRIVEN MONITORING

BACKGROUND OF THE INVENTION

1. Field of the Invention

The present invention relates to a patient rehabilitation system, more particularly, a rehabilitation system utilized for rehabilitation and physical therapy of injured limbs and joints. To elaborate further, the present invention is a continuous passive motion exercise system with a driven monitoring device, utilized for reflecting on the state changes of the adhesiveness and the stiffness of patients' injured joints for monitoring their rehabilitation conditions, as well as for controlling the rehabilitation mechanism safely.

2. Description of Related Arts

Limb joints, such as knee joints, hip joints, elbow joints and wrist joints are all crucial mechanisms for humans to conduct various activities, including walking, running, jumping, standing, stepping up and down of stairs, dancing and track-and-field activities that require twists, turns or weight-carrying of joints. In view of the dynamics of a human body, since joints have to sustain most of the weight loading during bodily activities or motions, joints are susceptible to injuries, and abrasions with age, especially for knee and hip joints that carry most of the body weight. After being injured or aged, such joints sometimes have to be cured by replacing with artificial joints, so as to resume original functions.

After surgeries, a long period of rehabilitation therapy soon follows for fully recovery, which might take from a few months to half a year, and thus causes patients great inconvenience. One of the rehabilitation therapy is to maintain continuous exercise of joints to avoid adhesiveness among tendons, and to supply nutrition to joints. In such ways, this procedure enables joints to resume the normal range of motion as soon as possible, and thus shortens the period of time for patients to stay in hospitals or in beds. Therefore, clinically, the continuous passive motion exercise systems are widely utilized in rehabilitation procedures after patients with surgeries on joints.

The continuous passive motion exercise systems currently employed cannot provide information regarding the patients' conditions of rehabilitation such as their progress and the effect of their therapy. Thus, doctors or professional rehabilitation personnel may only rely upon past experience to make decisions to adjust rehabilitation procedures to befit each patient. General clinical rehabilitation procedures usually employ simple and generic processes for all, not being able to vary according to individual states. Furthermore, since continuous passive motion exercise systems engages patients' injured joints and move reciprocatively, to certain joint flexing or extension angles during exercises, patients might feel pain. Such exercise systems, currently available without being able to automatically adjust properly to suit patients' needs, can only be manually stopped by patients themselves. The pain caused by overbending, overextending or speeding can only be inspected and relieved afterwards. Such a drawback might cause secondary injury to patients.

In addition, joints with general joint diseases such as osteoarthritis, after surgeries, are likely to be stiff and cannot act well. Current exercise systems are not able to provide proper indices showing states of stiffness for joints, as well as indices for the evaluation of joint rehabilitation. Therefore, during rehabilitation, precisely and effectively monitoring and recording the degree of stiffness and viscosity for joints not only avoid any ill operations of exercise machines so as to protect patients from further injuries, but also provide doctors and patients with more rehabilitation information, thus, to enable more effective and speedy therapies.

SUMMARY OF THE INVENTION

The object of present invention is to provide patients and doctors with the joint viscosity and stiffness variation statuses of patients during rehabilitation periods.

Another object of present invention is to provide patients with an extra safety-enhanced feature to prevent possible joint injuries doing continuous passive motion exercises all through mounting a driving-force or driving-torque monitoring and recording device onto a continuous passive motion device with the associated mathematical algorithms to calculate the necessary information.

After each rehabilitation session, such a system can provide several indices regarding the change of the joint viscosity and stiffness to indicate the current therapeutical progresses. And such indices can then be compared with previously stored rehabilitation indices so that the conditions of recovery of patients' joints can be acquired for the reference of doctors and patients. Therefore, the effects of current rehabilitation therapies can be analyzed and thus effective treatment and better rehabilitation process can be established. Furthermore, a safety-enhanced feature, built in the system, based upon the strength of patients' active joint muscle contraction, controls automatically the motion of the system so that when patients feel pains during exercises, the system will response accordingly in order to reduce the possible secondary injuries to patients.

Based upon the embodiments of the present invention, a continuous passive motion exercise system is provided for measuring the stiffness and viscosity of patients' joints, and reacts to the strength of patients' active muscle contractions so as to adjust the operations of such an exercise machine, which is comprised of a mounting device, having at least one degree-of-freedom mechanism capable of conducting reciprocative angular displacement; a driving device connected to the mounting device, for providing with a driving force or torque so as to continuously drive the mechanism to conduct reciprocative angular displacement motion; and a driven monitoring device comprising sensor means for sensing said driving force or torque.

In one aspect of the present invention, when the jointed limb of the patient is fastened onto the mounting device and brought to motions, the driven monitoring device then calculates the average of the work done by the driving force or torque in one complete cycle of many repeated and predetermined reciprocative angular displacement motion cycles in an assessment or a rehabilitation period. The said average defined as the joint agility average and the number of reciprocative cycles are then recorded and will be used to compare with the same patient's agility averages recorded previously or afterward, better with the same number of reciprocative cycles, through the same predetermined reciprocative motion pattern. The difference between two agility averages then represents the change of agility or viscosity of the joint from one state to another state. Hence, the changes in the whole recorded agility averages stands for the history of the variation of the agility or viscosity of the joint during the recorded assessment or rehabilitation period.

In another aspect of the present invention, when the jointed limb of the patient is fastened onto the mounting device and brought to motions, the driven monitoring device then calculates the average of the difference of the works done by said driving force or driving torque between the first half and the second half cycles in one complete cycle of many repeated and predetermined reciprocative angular displacement motion cycles during an assessment or a rehabilitation period. Then, the sign of the average work done by joint elastic force in the first half cycle will be determined from the same assessment period. The calculated average then multiplies the calculated sign to obtain the joint stiffness average. The joint stiffness average, and the number of reciprocative cycles are then recorded and will be used to compare with those recorded previously or afterward for the same patient, better with the same number of reciprocative cycles, through the same predetermined reciprocative motion pattern. The difference between two said joint stiffness averages then represents the change of elasticity or stiffness of the joint from one state to another state. Hence, the changes in the whole recorded joint stiffness averages stands for the history of the variation of the elasticity or stiffness of the joint during the recorded assessment or rehabilitation period.

In a further aspect of the present invention, when the jointed limb of the patient is fastened onto the mounting device and brought to motions for a continuous passive motion rehabilitation session, the driven monitoring device will record an average force (or torque) profile of the driving force (or troque) in one complete cycle for the first several cycles if no noticeable active joint muscle contractions or pains occur. Several stages of variations from the average profile are preset for the mounted device to slow down, stop or retract. The driven monitoring device then constantly compares the magnitude of abnormal variations from said average force (or torque) profile with the preset stages in each reciprocative angular displacement motion cycle so as to adjust the motion of the mounting device according to those presets.

In one more aspect of the present invention, the driven monitoring device comprises a data recorder to record and a data transceiver interface to receive from and transmit to external data storing and/or analyzing devices the associated values of the predetermined reciprocative motion pattern, numbers of cycles, said averages, duration of use, and patient's ID, for future analysis and evaluation.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENTS

The following is a detailed description of the presently known modes of carrying out the inventions. This description is not to be taken in a limiting sense, but is made merely for the purpose of illustrating the general principles of the inventions.

The present invention discloses a driven monitoring device, attached onto a continuous passive motion exercise system, with the functions of measuring the driving force F or torque $\tau$ from a driving device D to a mounting device 4, 8 through force or torque sensors S, calculating joint viscosity and stiffness parameters, and detecting joint muscle active contraction. Thus the status changes of muscle stiffness and joint viscosity can be evaluated and the possibility of secondary injury can be reduced during joint rehabilitation periods.

Figure 1:
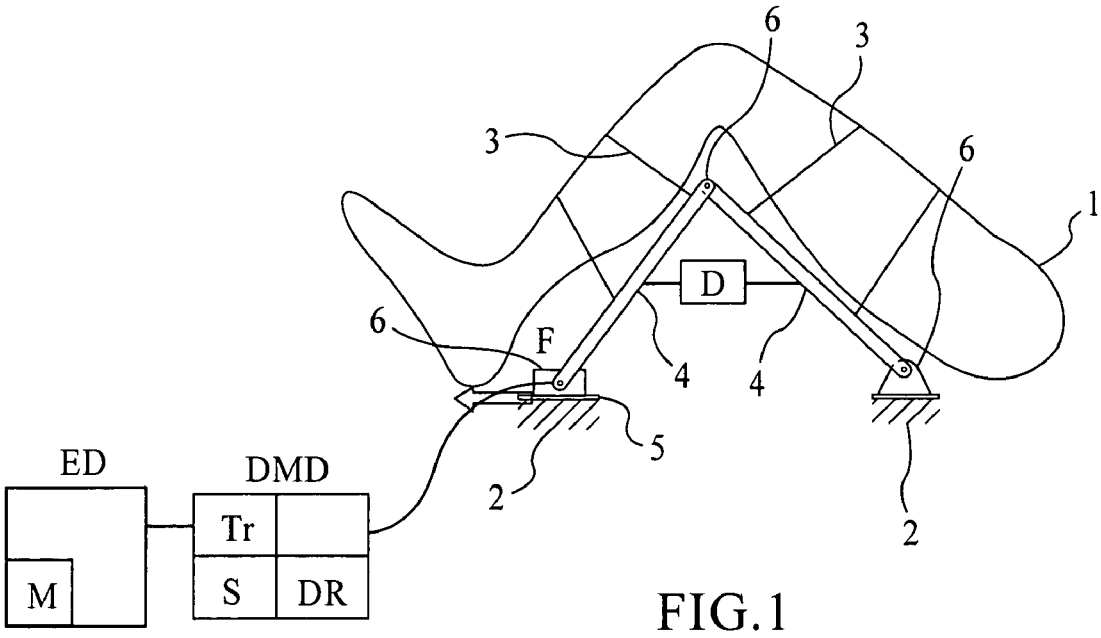
FIG. 1 shows a schematic diagram illustrating the present invention being applied on a knee joint continuous passive motion exercise mechanism.

The schematic diagram of the present invention applied on a knee join exercise mechanism with continuous passive operation is illustrated in FIG. 1. The exercise mechanism comprises a mounting device 4 having a flexing and extending mechanism and a fastening device 3, a driving device D providing a driving force F and a driven monitoring device DMD. The flexing and extending mechanism disposed on a ground 2 contains two levers, a horizontal sliding block 5, and a hinge set 6. The two levers are jointed together by one hinge of the hinge set 6 while the other two ends are pivotally jointed to the horizontal sliding block 5, and the ground 2, respectively. The horizontal sliding block 5 can slide horizontally and straight with respect to the ground 2. The driving force F, applied on the horizontal sliding block 5, can bring the block 5 back and forth to perform straight and horizontal reciprocative movement so as to conduct reciprocative angular displacement motion of the flexing and extending mechanism. Through a fasting device 3 on the mounting device 4, a lower limb 1 of a patient is fastened onto the mounting device 4. In this embodiment of the present invention, the exercise mechanism, being mounted on a bed or on the ground 2, therefore, forms a one degree-of-freedom mechanism capable of flexing and extending the knee joint of the lower limb 1 repeatedly. And the driving force F continuously drives the mounting device 4 and the lower limb 1 so as to perform knee-joint continuous passive motion exercise.

Figure 2:
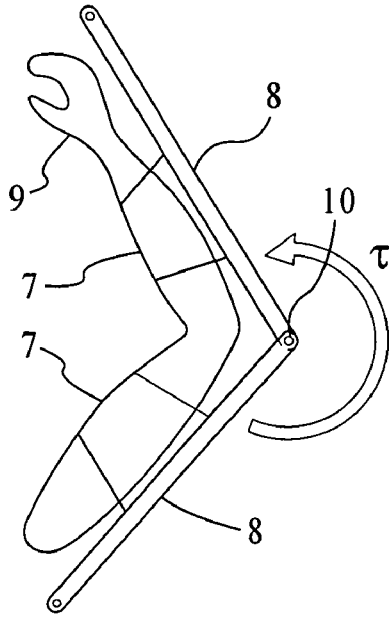
FIG. 2 shows a schematic diagram illustrating the present invention being applied on an elbow joint continuous passive motion exercise.

FIG. 2 illustrates the schematic diagram of the present invention applied on an elbow joint continuous passive motion exercise mechanism. Such an exercise mechanism comprises a mounting device 8, a hinge 10 and a driving device generating driving torque $\tau$. An upper limb 9 of a patient is fastened through a fastening device 7 onto the mounting device 8. The mounting device 8 contains two levers; and the two levers are jointed by the hinge 10. A driving torque $\tau$ on the hinge 10 repeatedly rotate one lever with respect to another clockwise and counterclockwise. Thus, the exercise mechanism forms a one degree-of-freedom mechanism capable of flexing and extending the elbow joint through the driving torque $\tau$. As the driving torque $\tau$ continuously applied on the hinge 10, the two levers rotate with respect to each other in a clockwise-counterclockwise movement, and the elbow-joint continuous passive motion exercise is performed.

Patients utilize the continuous passive motion exercise systems shown in FIG. 1 or FIG. 2 to bring joints to motions through an external force or torque, without active contracting his or her own muscles. Therefore, not only that the injured muscles are to recover through much needed rest, but the result that the joint tendons and muscles are to be sticky and stiff due to the lack of exercise can also be prevented; in addition, through twisting and turning of joints, joints are to obtain necessary lubrication and nutrients, thus preventing joints from atrophy.

Yet when patients are in such rehabilitation therapy sessions, it is the fear, both for pain and for possible secondary injury due to muscle weakness and stiffness, which leads to the angles of joint motions being confined within a small range, or the progress of rehabilitation being slowed down.

According to the embodiments of the present invention, a continuous passive motion exercise system comprises a driven monitoring device DMD, having force or torque sensors S corresponding to the exercise mechanism, so as to monitor the driving force F or the driving moment $\tau$ needed to perform continuous passive motion exercises, wherein F or $\tau$ is a vector with the dimension being identical to that of the degree of freedom of the mounting device 4, 8.

In one more aspect of the present invention, the driven monitoring device DMD comprises a data recorder DR to record and a data transceiver Tr interface to receive from and transmit to external data ED storing and/or analyzing devices M the associated values of the predetermined reciprocative motion pattern, numbers of cycles, said averages, duration of use, and patient's ID, for future analysis and evaluation.

Figure 3:
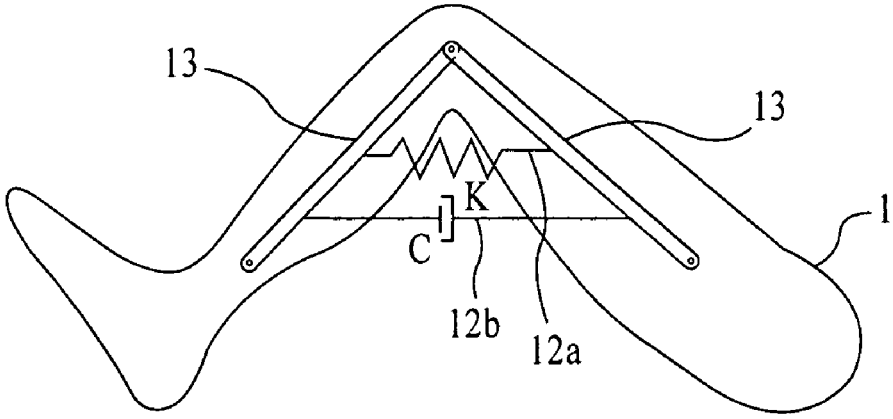
FIG. 3 shows a schematic diagram illustrating a simplified mechanical passive-motion model of a knee bone-muscle-joint system shown in FIG. 1.
Figure 4:
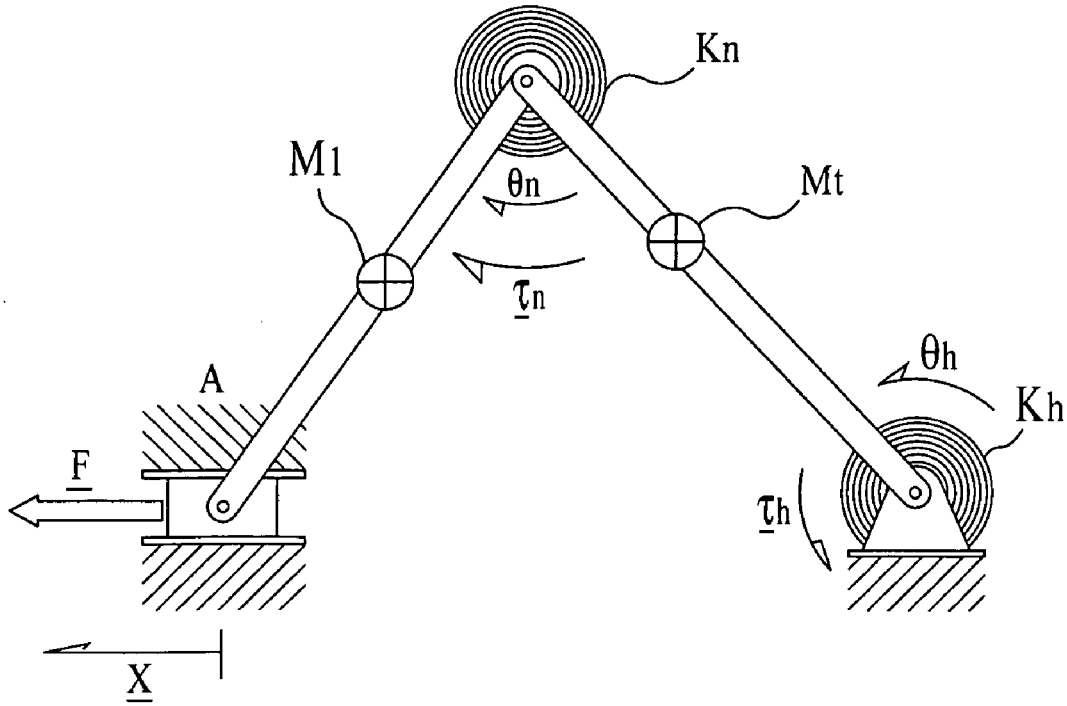
FIG. 4 shows a schematic diagram illustrating the combined mechanical model of the knee joint and the continuous passive motion rehabilitation system shown in FIG. 1.

The one degree-of-freedom exercise system shown in FIG. 1 is to be utilized for illustrating the rehabilitation system. At first, to model the mechanics system of the bone-muscle system of a joint under passive motion, two kinds of internal forces can be defined; one is conservative elastic force (such as spring force with an elastic coefficient K) from the conservative elastic force member 12*a*, and the other non-conservative force (such as viscosity, friction, etc. with a damping coefficient C) from the non-conservative force member 12*b* as illustrated in FIG. 3. Therefore, the mechanics model of the rehabilitation system shown in FIG. 1, providing both thigh and leg are fastened on the two levers 13 of the mounting device 4, can be shown as in FIG. 4, wherein $M_t$ is the equivalent mass of the thigh and the lever whereon the thigh is fastened, $M_l$ is the equivalent mass of the leg and the lever whereon the leg is fastened (a foot is regarded as part of the leg), $\theta_n$ and $\theta_h$ are the angular displacement vector of the knee joint and the hip joint respectively with the assumption of no relative motion between a limb and its mounting device, point A is a reference point fixed in the horizontal sliding block 5 which can only move straightly and horizontally with respect to the ground 2, x is the displacement vector of point A with respect to the ground 2, $K_n$ is the effective coefficient of elasticity for the total passive conservative elastic force stored in the knee joint muscles and tendons, $\tau_n$ is the friction moment vector generated on the center of rotation of the knee joint, $k_h$ is the effective coefficient of elasticity for the total passive conservative elastic force stored in the hip joint muscles and tendons, and $\tau_h$ is the friction moment vector generated on the center of rotation of the hip joint. It is assumed that $k_n$ is a function of $\tau_n$ only and $k_h$ is a function of $\theta_h$ only. Both $k_n$ and $k_h$ have nothing to do with the directions and the velocity of their associated joint motions. Thus, $(k_n\ \theta_h+c_n)$ is the total conservative elastic force when the knee joint muscles and tendons are passively brought to an angular displacement $\tau_n$; wherein $c_h$ is a constant. And $(k_h\ \tau_h+c_h)$ is the total conservative elastic force when hip joint muscles and tendons are passively brought to an angular displacement $\theta_h$, wherein $c_h$ is a constant.

According to the embodiments of the present invention, during a cycle of passive reciprocative motion, the amount of work ($W_F$) done by the horizontal driving force vector F equals to $$W_F=-(W_d+W_n+W_h) \tag{1}$$

wherein $W_d$ represents the work done by the total friction of the mechanism, $W_n$ represents the work ($\int\tau_n\cdot d\theta_n$) done by the knee joint friction moment vector $\tau_n$, $W_h$ represents the work ($\int\tau_h\cdot d\theta_h$) done by the hip joint friction moment vector $\tau_h$, and the total amount of work from the gravitational force and/or other conservative elastic forces in one complete cycle of motion is zero.

Assuming in each cycle of a passive reciprocative motion, the displacement and velocity patterns of the mounting device are all to be kept the same. Then $W_d$ in each cycle can be regarded as identical (assuming the operational environment including temperature and humidity and the mass of the leg portion pose little alteration or impact). Therefore, between two complete cycles of passive reciprocative motions, the difference regarding the amounts of the work done by the horizontal driving force F is as follows:

$$\Delta W_F=-\Delta(W_d+W_n+W_h)=-\Delta(W_n+W_h) \tag{2}$$

wherein $\Delta$ is the operand for the difference obtained from the latter value minus the former value.

Hence, $\Delta W_F$ reflexes only the change in the work done by joint friction. Since the motion path of two cycles are the same, $\Delta W_F$ represents the change in joint friction between two cycles. In the present invention, $\Delta W_F$ can be divided by the total displacement distance 2L during one cycle of passive motion, wherein L represents the farthest horizontal distance that the reference point A moves with respect to the ground in one cycle, so as to define the variation of the average joint friction force $\Delta F_b$. Therefore, when the joint friction becomes smaller, index $\Delta F_b$ shall become positive. A negative value of $\Delta F_b$ thus, indicates the increase of the joint friction.

Therefore, regarding the system of the present invention, when passive reciprocative motions proceed under extremely repeatable speed, the driven monitoring device then measures the driving force F, so as to calculate and monitor the amount of variation of the average joint friction force $\Delta F_b$ during the rehabilitation process, and thus obtains the state of variation regarding the joint friction and viscosity. Since the joint friction force might be very minute compared to the other force sources involved, to monitor the variation of such joint friction, the present invention averages the $W_F$ value of a plurality of cycles (such as 1000 cycles) of passive reciprocative motions with identical displacement and velocity patterns and compare these averages recorded the same way in different rehabilitation sessions to observe the state of variation of the agility of joints. In such a way, the possible noise caused by the variations of the rehabilitation system and environment can be reduced.

Furthermore, the strength of elasticity regarding muscles and tendons at joint is also one of the indices for joint rehabilitation. Considering the system shown in FIG. 1, in half of a complete cycle of passive reciprocative motion such as the flexing motion cycle, based on the principle of work, the equation can be written as $$W_{F(i)}+W_{JK(i)}+W_{MK(i)}+W_{Mf(i)}+W_{GF(i)}+W_{Jf(i)}=0;\ i=1,\ \text{or}\ 2 \tag{3}$$

Where variables with subscript (1) or (2), respectively denote their values at the first or the other half cycle of passive reciprocative motion which originates from one end position with zero velocity and ends at the other end position with zero velocity; and $W_{JK(i)}$, $W_{MK(i)}$, $W_{Mf(i)}$, $W_{GF(i)}$, and $W_{Jf(i)}$ denote the work done by conservative joint elasticity force, conservative machine elasticity force, machine friction force, gravitational force, and knee-and-hip joint friction force respectively in the i-th half cycle. By subtracting $W_{F(1)}$ from $W_{F(2)}$, the following equation is obtained as $$W_{F(2-1)}=(W_{JK(1)}-W_{JK(2)})+(W_{MK(1)}-W_{MK(2)})+(W_{Mf(1)}-W_{Mf(2)})+(W_{GF(1)}-W_{GF(2)})+(W_{Jf(1)}-W_{Jf(2)}) \quad (4)$$

Wherein $W_{F(2-1)}$ is defined as $(W_{F(2)}-W_{F(1)})$.

As described above, if the displacement and velocity patterns for the motion of the mounting device to be identical and the change in the mechanic characteristics of the machine are maintained to be very small and negligible during each cycle of a reciprocative passive motion, each $(W_{GF(1)}-W_{GF(2)})$, $(W_{MK(1)}-W_{MK(2)})$, and $(W_{Mf(1)}-W_{Mf(2)})$ value can be regarded as identical in each cycle. Therefore, the difference of $W_{F(2-1)}$ between two cycles of motion can be obtained as follows:

$$\Delta W_{F(2-1)}=\Delta(W_{JK(1)}-W_{JK(2)})+\Delta(W_{Jf(1)}-W_{Jf(2)}) \quad (5)$$

Assuming that the change of a human joint friction with respect to time is independent of the direction of the joint rotation, then the term $\Delta(W_{Jf(1)}-W_{Jf(2)})$ equals to zero. Therefore, the equation can be written as $$\Delta W_{F(2-1)}=\Delta(W_{JK(1)}-W_{JK(2)}) \quad (6)$$

Since $W_{JK(i)}$, i=1 or 2, is a work done by a conservative force, $W_{JK(2)}$ is equal to $-W_{JK(1)}$. Hence, the equation becomes $$\Delta W_{JK(1)}=\Delta W_{F(2-1)}/2 \quad (7)$$

Since $W_{JK(1)}$ is dependent on the initial and the end positions of the first half cycle of a reciprocative passive motion only, if the two positions are chosen so that $W_{JK(1)}$ is equal to zero, it is possible that the effect of elasticity change in joint will not be shown in the above equation. In such cases, a different initial position or a different end position should be chosen. However, $\Delta W_{JK(1)}$ along is not enough to determine whether the elastic force is increasing or decreasing, thus the sign of $W_{JK(1)}$ has to be known to correctly interpret the result. When $W_{JK(1)}$ is positive, the potential energy due to the conservative elastic force of the joint in the first half cycle is increasing. A positive $\Delta W_{JK(1)}$ then means that the average elastic force is increasing, hence the average stiffness is increasing, and vice versa. When $W_{JK(1)}$ is negative, the potential energy due to the conservative elastic force of the joint in the first half cycle of the joint is decreasing. A positive $\Delta W_{JK(1)}$ means that the average elastic force is decreasing, hence, the stiffness is decreasing, and vice versa. Eqn. (4) can be rewritten as, $$(W_{JK(1)}-W_{JK(2)})-W_{F(2-1)}-(W_{MK(1)}-W_{MK(2)})-(W_{Mf(1)}-W_{Mf(2)})-(W_{GF(1)}-W_{GF(2)})-(W_{Jf(1)}-W_{Jf(2)}) \quad (8)$$

By running the same reciprocative motion without any limb mounted onto the machine and assuming the term $(W_{Mf(1)}-W_{Mf(2)})$ is either close to zero or has little to do with or without a limb mounted, The following equation can be obtained $$W_{F0(2-1)}=W_{F0(2)}-W_{F0(1)}=(W_{MK(1)}-W_{MK(2)})+(W_{Mf(1)}-W_{Mf(2)})+(W_{GF0(1)}-W_{GF0(2)}) \quad (9)$$

where $W_{F0(i)}$, $W_{GF0(i)}$; i=1 or 2 is the work done by the driving force, and the gravitational force on the machine, respectively without any limb mounted in the i-th half cycle. From eqns. (8) and (9) and assuming $W_{Jf(1)}=W_{Jf(2)}$, the equation can be written as $$2W_{JK(1)}=W_{F(2-1)}-W_{F0(2-1)}-2W_{GFb(1)}; \quad (10)$$

where $W_{GFb(1)}$ is the work done by the gravitational force on the limb in the first half cycle and can be calculated from the configurations of the limb at the two end positions in a half cycle of a reciprocated motion. Hence, from eqn. (10), the sign of $W_{JK(1)}$ can be determined.

Through Combining eqn. (7) and eqn. (10), the average change of the joint elastic status between the two cycles can be defined as $$\Delta W_K=W_{JK(1)}\Delta W_{F(2-1)}/(2\times|W_{JK(1)}|) \quad (11)$$

In the embodiments of the present invention, when $\Delta W_K$ is positive, the average internal elastic force of the joint is increased. It represents that the degree of rigidity for the joint muscles and tendons is to become larger, and vice versa. Therefore, a variation of the agility of joints which can be obtained through the driven monitoring device has developed to better understand the effect of a rehabilitation session. Regarding the system of the present invention, $\Delta W_K$ can be divided by the length L, the travel distance of point A in the half cycle of passive reciprocative motion, and obtain the amount of variation for the average elastic force $F_K$ as follows:

$$\Delta F_K=W_{JK(1)}\Delta W_{F(2-1)}/(2L\times|W_{JK(1)}|)$$

The driven monitoring device then is capable of comparing the impact during the rehabilitation processes regarding the elasticity of joint muscles in every time or every day by utilizing $\Delta F_K$ calculated.

The comparative index values regarding agility and elasticity are suitable for the comparison of variation between two cycles of motion with identical displacement, velocity. In overall terms of rehabilitation, the range of motion, the displacement and velocity should be properly adjusted or altered. Therefore, when the embodiments of the present invention are to compare the effect of the rehabilitation session from certain periods or the overall process, the user can adjust the displacement and velocity of the exercise mechanism back to the setup that is intended to compare, then the driven monitoring device may proceed to the effect assessment.

All the evaluations of the embodiments above presuppose that the joint muscles do not perform active contractions to produce tension. In another embodiment of the present invention, the driven monitoring device further comprises a data recorder capable of storing a sequence of reference values of the driving force F at different sampling positions and orientations during motions. Such values are obtained when the joint muscles of patients do not contract actively. The average of all the values at the same sampling position and orientations in different cycles for the first several cycles is used to represent the reference value of the driving force F at the same sampling position and orientation during a continuous passive motion session. An offset is set up in the driven monitoring device, which continuously monitors whether the absolute value of the difference between the driving force F value and the corresponding reference value at the same position and orientation during the cycles of motion is to exceed the offset; if so, muscles might have actively contracted (such as muscle contraction due to pain). Joints after surgeries are to be more frail than those under normal conditions, and muscles are also under recovering condition, therefore, excessive pulling or squeezing might cause muscle tear or joint dislocations. The present invention provides an exercise system with the automatic safety control function (such as stopping the system operations), thus preventing patients from possible secondary injuries. The system of the present invention can also set up several offsets so that more proper reactions can be performed during rehabilitation sessions (such as receding back or slowing down the exercise motion.)

In addition, since rehabilitation sessions might take tremendous length of time, medical personnel or patients themselves cannot record and monitor the rehabilitation indices at all time, and during the rehabilitation session, large amount of data are needed to be stored, so as to conduct analyses, follow-ups and display. Therefore, the system of the present invention has a data recorder, through which detailed measurement and calculated data are to be recorded during the rehabilitation sessions and then transmitted to other devices to be stored, thus enabling medical personnel or patients to perform more precise analyses, long-term follow-ups and statistics. Meanwhile, when the system of the present invention is utilized by several patients, the set-ups of the machine can easily be retrieved to fit the need of every patient.

By the same token, regarding the present invention and other devices, persons skilled in the art are able to make proper variations based upon the calculation methods disclosed herein so as to obtain the effects and characteristics of the invention.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

We claim:

1. A continuous passive motion exercise system for exercising a patient's jointed limb, comprising:

a mounting device, having a flexing and extending mechanism capable of conducting reciprocative angular displacement;

a driving device connected to said mounting device, for providing with a driving force or torque so as to continuously drive said flexing and extending mechanism to conduct reciprocative motion;

a driven monitoring device comprising sensor means for sensing said driving force or torque;

and wherein when a patient's jointed limb is fastened onto said mounting device and brought to motion passively to exercise the joints involved, said driven monitoring device calculates the average difference between the work done in each first half cycle and the work done in each another half cycle of the passive motion by said driving force or torque of said driving device so as to quantify the elasticity degree of said joints during the exercise.

2. The exercise system of claim 1, wherein said driven monitoring device comprises a data recorder for recording the exercise data of said average difference, motion setting of the exercise, number of cycles of the exercise, duration of the exercise, starting time of the exercise, or patient IDs.

3. The exercise system of claim 1, said driven monitoring device transmits said exercise data to an external device for analysis or storage.

4. The exercise system of claim 1, wherein the driven monitoring device contains a means for calculating differences of said average difference so as to obtain the indices for the variations regarding the elasticity or stiffness of said joints among exercises.

5. A continuous passive motion exercise system for exercising a patient's jointed limb, comprising:

a mounting device, having at least one flexing and extending mechanism;

a driving device connected to said mounting device, for providing with a driving force or torque so as to continuously drive said flexing and extending mechanism to conduct reciprocative flexing and extending motion;

a driven monitoring device comprising sensor means for sensing said driving force;

and wherein when a patient's jointed limb is fastened onto said mounting device and brought to motion passively to exercise the joints involved, said driven monitoring device detects abnormal variations from said driving force of said driving device in each cycle of passive flexing and extending motion so as to adjust said motion to reduce speed, reverse in motion or stop in accordance with the amplitude of the abnormal variations, wherein said driven monitoring device comprises a data recorder for recording the average values of said driving force at different positions and orientations of motion in a cycle over the first several cycles of said passive flexing and extending motion as a reference sequence of values for the normal driving force of said passive flexing and extending motion, wherein said driven monitoring device calculates the absolute difference between said driving force and, said normal driving force at the same position and orientation of motion in following continuous passive motion cycles so as to quantify the variations of said driving force.

6. The exercise system of claim 5, wherein said driven monitoring device includes means for setting at least one offset so that when said variations of said driving force exceeds said offset, said abnormal variations occurs.

* * * * *